US010120339B2

(12) United States Patent
Kammer

(10) Patent No.: US 10,120,339 B2
(45) Date of Patent: Nov. 6, 2018

(54) DEVICE FOR HOLDING A WHEEL SET

(71) Applicant: ETA SA Manufacture Horlogere Suisse, Grenchen (CH)

(72) Inventor: Adrian Kammer, Wiler (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 0 days.

(21) Appl. No.: 15/397,956

(22) Filed: Jan. 4, 2017

(65) Prior Publication Data

US 2017/0308038 A1 Oct. 26, 2017

(30) Foreign Application Priority Data

Apr. 25, 2016 (EP) ..... 16166877

(51) Int. Cl.

| | |
|---|---|
| ***G04B 19/26*** | (2006.01) |
| ***G04B 15/14*** | (2006.01) |
| ***G04B 13/02*** | (2006.01) |
| ***G04B 31/00*** | (2006.01) |
| ***G04B 35/00*** | (2006.01) |

(52) U.S. Cl.

CPC ..... *G04B 19/268* (2013.01); *G04B 13/02* (2013.01); *G04B 15/14* (2013.01); *G04B 31/00* (2013.01); *G04B 35/00* (2013.01)

(58) Field of Classification Search

CPC ..... G04B 19/268; G04B 13/02; G04B 15/14; G04B 31/00; G04B 35/00; G04B 33/10; G04F 7/08; G04F 8/006

USPC ..... 368/221, 108

See application file for complete search history.

(56) References Cited

U.S. PATENT DOCUMENTS

| | | | | |
|---|---|---|---|---|
| 3,452,539 A * | 7/1969 | Inoki | G04B 27/004 368/105 |
| 7,458,717 B2 * | 12/2008 | Baumberger | G04B 15/06 368/127 |
| 7,522,478 B2 * | 4/2009 | Moteki | G04B 21/08 368/269 |

FOREIGN PATENT DOCUMENTS

| | | |
|---|---|---|
| CH | 336014 | 1/1959 |
| CH | 661 404 | 7/1987 |

OTHER PUBLICATIONS

European Search Report dated Oct. 14, 2016 in European Application16166877.7, filed on Apr. 25, 2016 (with Translation of Categories of cited documents and Written Opinion).

* cited by examiner

*Primary Examiner* — Edwin A. Leon
(74) *Attorney, Agent, or Firm* — Oblon, McClelland, Maier & Neustadt, L.L.P.

(57) ABSTRACT

A device for holding a wheel set of a timepiece movement mounted on a main plate includes a lever, intended to be mounted to slide on the main plate of the timepiece movement between a first and a second position and arranged to move in translation between the two positions. The lever includes, at a first end, a locking beak cooperating with a slot of a ring attached to the wheel set to hold and to guide the wheel set in rotation in the first position, and leaving the wheel set free in the second position, the lever being arranged to move in translation, between the retracted position and the deployed position.

11 Claims, 2 Drawing Sheets

DEVICE FOR HOLDING A WHEEL SET

This application claims priority from European Patent Application No 16166877.7 of Apr. 25, 2016, the entire disclosure of which is hereby incorporated herein by reference.

FIELD OF THE INVENTION

The invention relates to the field of horology and, in particular, the field of watches. The invention more particularly concerns a device for holding and guiding in rotation a wheel set of a timepiece movement.

BACKGROUND OF THE INVENTION

The prior art comprises numerous documents relating to devices for holding wheel sets.

It is known to attach the wheel sets of a movement by means of a screw, by pressing them onto an arbor or by using a retaining ring. For example, moon phase display discs are generally retained by a screw or an arbor at their centre, or by a guide ring, which reduces the display surface of the wheel set.

Thus, to increase the display surface one can simply dispense with these holding means, but the holding in place of the wheel set is then no longer ensured.

SUMMARY OF THE INVENTION

It is an object of the invention to overcome the various drawbacks of these known techniques.

More precisely, it is an object of the invention to provide a device for holding and guiding in rotation a wheel set to obtain a wheel set with a larger display surface and which is simple and inexpensive to implement.

These objects, in addition to others, which will appear more clearly below, are achieved according to the invention by means of a device for holding a wheel set of a timepiece movement comprising a lever, intended to be mounted to slide via guide means on the main plate of the timepiece movement between a first and a second position.

According to the invention, the lever includes, at a first end, a locking beak intended to cooperate with the wheel set holding means to hold and guide the wheel set in rotation in the first position and to leave it free in the second position, the lever being arranged to be able to move in translation, between a retracted position and a deployed position.

Thus, the subject of the present invention, through the different functional and structural aspects described above, makes it possible to obtain a reliable and compact device for holding a wheel set of a timepiece movement.

In accordance with other advantageous variants of the invention:

- the wheel set holding means comprise a ring, attached to the wheel set, the ring having a slot capable of cooperation with the beak of the lever;
- the slot extends continuously over the circumference of the ring;
- the guide means comprise at least one opening in which engages a first screw intended to be secured to the main plate and arranged to ensure the guiding of the lever;
- the guide means comprise a second opening in which engages a second screw intended to be secured to the main plate and arranged to ensure the locking of the lever;

- the main plate comprises a housing configured for receiving the other end, called the free end, of the lever;
- the device may comprise elastic return means disposed inside the housing and acting on the free end of the lever to bias the lever to the deployed position;
- the free end of the lever comprises a manipulation hole for moving the lever.

The invention also concerns a timepiece including a device according to the invention.

BRIEF DESCRIPTION OF THE DRAWINGS

Other characteristics and advantages of the invention will appear more clearly upon reading the following description of a specific embodiment of the invention, given simply by way of illustrative and non-limiting example, and the annexed Figures, among which.

DETAILED DESCRIPTION OF PREFERRED EMBODIMENTS

Figure 1A:
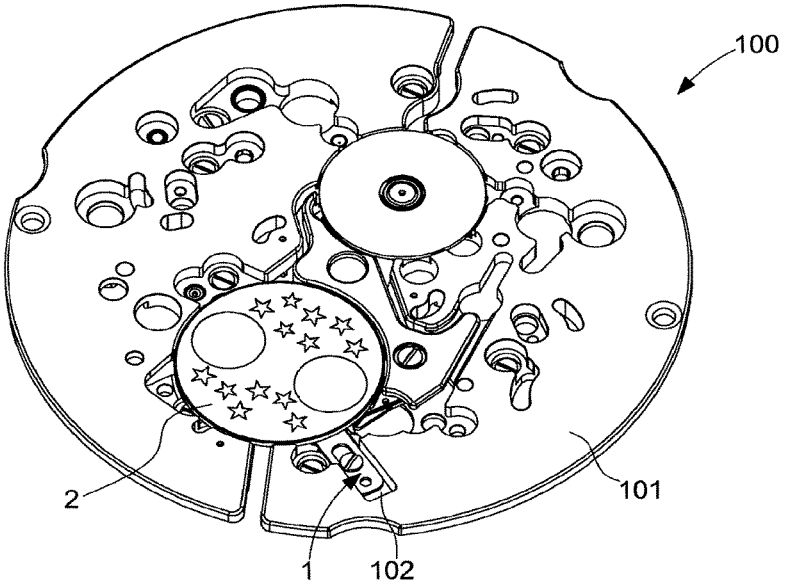
FIGS. 1*a* and 1*b* are respectively a perspective view and an exploded view of a timepiece movement including a holding device according to the invention.

A device for holding a wheel set of a timepiece movement according to the invention will now be described below with reference jointly to FIGS. 1*a* to 3*b*.

According to the present embodiment, the timepiece movement is intended for the design of a timepiece comprising a moon phase display wheel set and consequently includes a device for driving this wheel set, housed inside the back cover of the timepiece.

Of course, the invention applies to any type of wheel set for the display of information, and the example of the moon phase display wheel set is given as an illustrative and non-limiting example.

The invention concerns a device for holding a wheel set 2 of a timepiece movement 100 mounted on a main plate 101 by means of an arbor 22. The device comprises a lever 1 intended to be mounted to slide via guide means on main plate 101 of the timepiece movement, between a first and a second position.

Advantageously, lever 1 includes, at a first end, a locking beak 10 intended to cooperate with means for holding wheel set 2 to hold and guide the wheel set in rotation in the first position and to leave it free in the second position, lever 1 being arranged to be capable of moving in translation, between the first position, called the deployed position, and the second position, called the retracted position.

Figure 2:
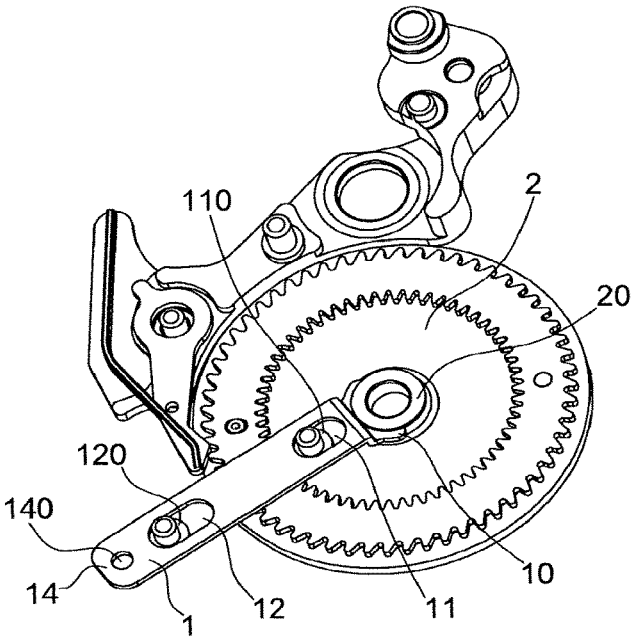
FIG. 2 is a bottom perspective view of the holding device according to the invention in the deployed position.
Figure 3B:
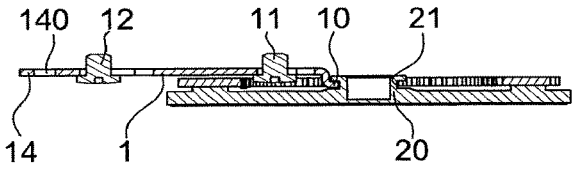
FIGS. 3*a* and 3*b* respectively illustrate a bottom view and a cross-sectional view of a device according to the invention in the deployed position.
Figure 3A:
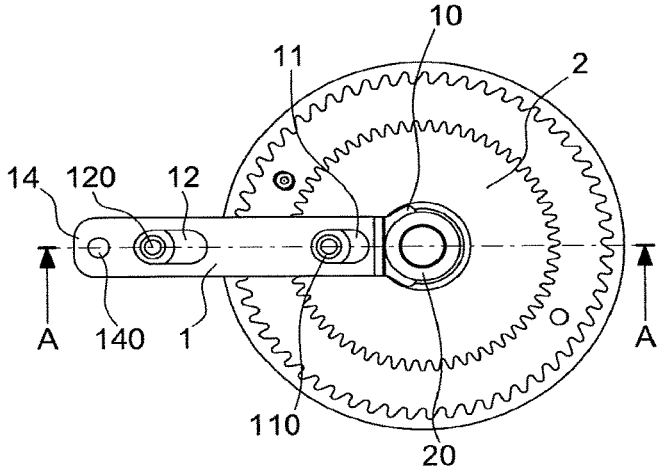

As seen in FIG. 2, lever 1 takes the form of a thin metal plate, obtained by stamping for example, which is slidably mounted on main plate 101 of timepiece movement 100.

As represented in the Figures, lever 1 has a first planar part, called the body of the lever, and a second raised part, called beak 10 of lever 1, which is in a parallel plane to the plane formed by the lever body. Of course, a lever without a raised beak could be envisaged, i.e. which is planar over its entire length.

Lever 1 comprises a beak 10 intended to cooperate with means for holding wheel set 2 to hold and guide it in rotation on its arbor 22, the wheel set holding means could take the form of a ring 20 integral with wheel set 2. Advantageously, ring 20 has a slot 21 capable of cooperating with beak 10 of lever 1; slot 21 extends continuously over the circumference of ring 20, and the cooperation of beak 10 with slot 21 allows the wheel set to be held axially and guided in rotation. Thus, wheel set 2 cannot be dislodged from its arbor 22 given that it is held axially by lever 1.

According to the invention, the guide means comprise at least a first, oblong through opening 11 formed in lever 1, in which engages a first screw 110 intended to be secured in a hole in main plate 101 and arranged to ensure the guiding in translation of lever 1. First screw 110 also allows the lever to be held in place, first screw 110 being partially screwed in and the screw head being arranged to be wider than the opening so as to eliminate any risk of lever 1 being released.

The guide means also comprise a second, oblong through opening 12 formed in lever 1, upstream of first opening 11, and in which engages a second screw 120 intended to be secured in a hole in main plate 101 and arranged to ensure the locking of lever 1. Second screw 120 allows lever 1 to be locked in its deployed position by tightening said screw with sufficient torque for the screw head to retain lever 1, thereby eliminating the risk of displacement of the lever.

It will be noted that the length of openings 11 and 12 defines the length of travel of lever 1.

Figure 1B:
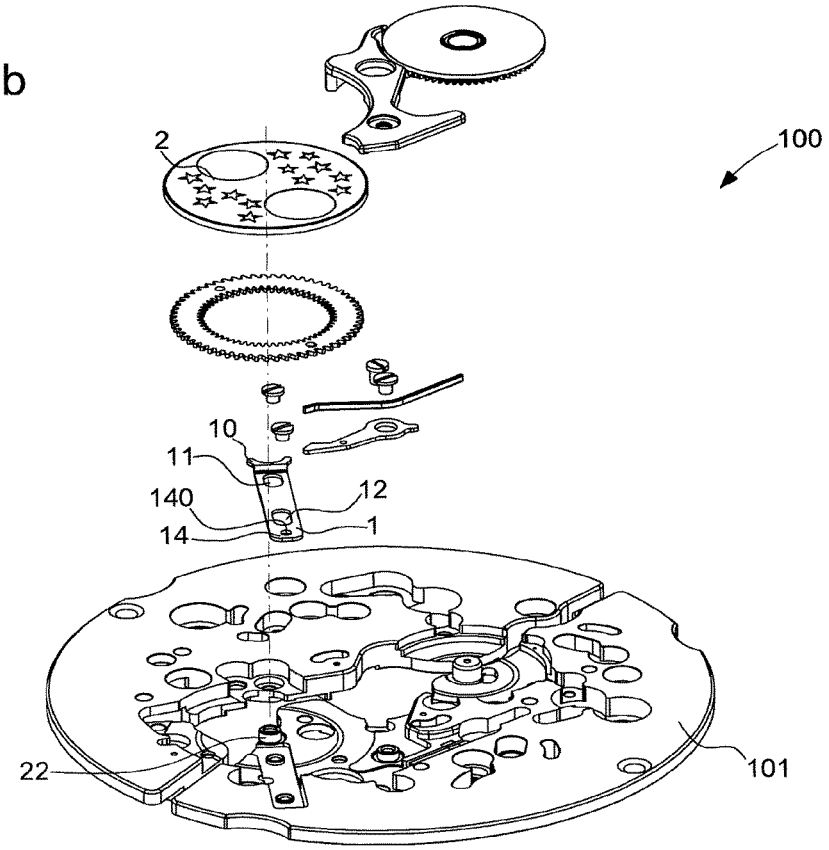

According to the invention, and as illustrated in FIG. 1, main plate 101 comprises a housing 102 configured for receiving the free end of lever 1, namely the end opposite beak 10.

Advantageously, elastic return means, such as a spring, may be disposed inside housing 102, at the end thereof and in contact with the free end of lever 1, to bias the latter to the deployed position and possibly act as a safety member in case screws 110 and 120 become unscrewed.

The device for holding wheel set 2 is set in place as follows.

First, lever 1 is positioned against main plate 101 such that the first and second openings 11 and 12 are aligned with the holes in plates 101 intended to receive screws 110 and 120, and such that the free end rests inside housing 102 provided for this purpose. Next, first and second screws 110 and 120 are inserted and partially screwed in to hold lever 1 in place so that the latter can slide along the screws.

Lever 1 is then moved into the retracted position, second screw 120 is tightened to hold lever 1 in the retracted position and the tightening of first screw 110 is adjusted to allow translation of lever 1 once second screw 120 has been loosened to allow lever 1 to move into the deployed position.

Finally, wheel set 2 is positioned on an arbor of main plate 101, second screw 120 is loosened to allow lever 1 to move into the deployed position so that beak 10 is inserted into slot 21 of ring 20 of wheel set 2, and it is thereby held axially and in rotation about its arbor. Finally, second screw 12 is tightened to hold lever 1 in the deployed position.

As a result of these different aspects of the invention there is obtained a device for holding a wheel set of a timepiece movement that can adapt to different calibre sizes and is easy to set in place. The invention also facilitates assembly/disassembly operations and maintenance of a timepiece equipped with a device according to the invention.

The above description corresponds to a preferred embodiment and should in no way be considered limiting, more particularly as regards the shape described for the various structural elements forming the mounting device, or their materials.

NOMENCLATURE

1. Lever
10. Beak
11. First opening
12. Second opening
110. First screw
120. Second screw
2. Wheel set
20. Ring,
21. Slot
22. Wheel set arbor
100. Movement,
101. Main plate
102. Housing

What is claimed is:

1. A device for holding a wheel set of a timepiece movement comprising:

a lever mounted to slide via guide means on a main plate of the timepiece movement between a first and a second position, the lever slides in a linear direction corresponding to a longitudinal axis of the lever, wherein the lever includes, at a first end, a locking beak cooperating with means for holding the wheel set to hold and to guide the wheel set in rotation in the first position and leaving the wheel set free in the second position, the lever being arranged to move in translation between the first position and the second position, and wherein the first position is a retracted position and the second position is a deployed position.

2. The device according to claim 1, wherein the means for holding the wheel set include a ring attached to the wheel set, the ring having a slot arranged to cooperate with the locking beak of the lever.

3. The device according to claim 2, wherein the slot extends continuously over a circumference of the ring.

4. The device according to claim 1, wherein the guide means include at least one opening in which engages a first screw being secured to the main plate and arranged to ensure the guiding of the lever.

5. The device according to claim 1, wherein the guide means include at least a second opening in which engages a second screw being secured to the main plate and arranged to ensure locking of the lever.

6. The device according to claim 1, wherein the main plate includes a housing configured for receiving a free end of the lever.

7. The device according to claim 6 further comprising elastic return means disposed inside the housing and acting on the free end of the lever to bias the lever to the deployed position.

8. The device according to claim 6, wherein the free end of the lever includes a manipulation hole for moving the lever.

9. The device according to claim 7, wherein the free end of the lever includes a manipulation hole for moving the lever.

10. A timepiece comprising the device according to claim 1.

11. The device according to claim 4, wherein the lever slides a length of the opening.

* * * * *